US011429056B2

(12) United States Patent
Ambe

(10) Patent No.: US 11,429,056 B2
(45) Date of Patent: Aug. 30, 2022

(54) IMAGE FORMING APPARATUS HAVING MAIN BODY AND ATTACHABLE OPTIONAL DEVICE

(71) Applicant: BROTHER KOGYO KABUSHIKI KAISHA, Nagoya (JP)

(72) Inventor: Yurimi Ambe, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/232,823

(22) Filed: Apr. 16, 2021

(65) Prior Publication Data

US 2021/0325820 A1 Oct. 21, 2021

(30) Foreign Application Priority Data

Apr. 20, 2020 (JP) ..... JP2020-074759

(51) Int. Cl.
*G03G 21/16* (2006.01)

(52) U.S. Cl.
CPC ..... *G03G 21/1619* (2013.01)

(58) Field of Classification Search
CPC ..... G03G 21/1619; G03G 21/1642; G03G 21/1647
See application file for complete search history.

(56) References Cited

U.S. PATENT DOCUMENTS

| | | | | |
|---|---|---|---|---|
| 5,666,595 | A | 9/1997 | Sameshima et al. | |
| 6,580,886 | B1 * | 6/2003 | Howard | G03G 21/1619 399/110 |
| 2017/0108818 | A1 * | 4/2017 | Hashimoto | G03G 21/1619 |
| 2017/0315497 | A1 * | 11/2017 | Sejima | G03G 21/1619 |

FOREIGN PATENT DOCUMENTS

| | | | |
|---|---|---|---|
| JP | 8-157082 | A | 6/1996 |
| JP | 11-127293 | A | 5/1999 |
| JP | 2003-207962 | A | 7/2003 |

* cited by examiner

*Primary Examiner* — Sandra Brase
(74) *Attorney, Agent, or Firm* — Merchant & Gould P.C.

(57) ABSTRACT

An image forming apparatus, having a main body including an image forming device, an optional device configured to be attached to a lower side of the main body, a recessed section formed at a lower position in the main body for clutching by a hand, and a fastening member arranged in the recessed section to fasten the main body and the optional device to each other, is provided.

12 Claims, 9 Drawing Sheets

IMAGE FORMING APPARATUS HAVING MAIN BODY AND ATTACHABLE OPTIONAL DEVICE

CROSS REFERENCE TO RELATED APPLICATION

This application claims priority from Japanese Patent Application No. 2020-074759, filed on Apr. 20, 2020, the entire subject matter of which is incorporated herein by reference.

BACKGROUND

Technical Field

An aspect of the present disclosure is related to an image forming apparatus.

Related Art

An image forming apparatus, such as a laser printer, having a main body, to which an optional device, such as a sheet cassette, is attachable at a lower side of the main body, is known. The optional device may have flange members on lateral faces thereof and may be fastened to the main body with the flange members screwed to lower lateral faces of the main body.

SUMMARY

When the optional device is attached to the main body, the flange members may protrude sideward from the lateral faces of the main body. Therefore, the flange members and the screws may be easily found by a user, and the user may remove the screws without knowing the fastening role of the screws and the flange members to the main body.

The present disclosure is advantageous in that an image forming apparatus, to which an optional device is attachable at a lower side of a main body, and in which a fastening member is less easily recognizable to a user, is provided.

According to an aspect of the present disclosure, an image forming apparatus, having a main body including an image forming device, an optional device configured to be attached to a lower side of the main body, a recessed section formed at a lower position in the main body for clutching by a hand, and a fastening member arranged in the recessed section to fasten the main body and the optional device to each other, is provided.

According to another aspect of the present disclosure, an image forming apparatus, having a photosensitive drum, a sheet cassette, a housing, a multitiered cassette unit, a connector, and a fastening member, is provided. The housing accommodates the photosensitive drum and the sheet cassette. The housing includes a recess for clutching by a hand. The recess is formed at a lower position of the housing and is open laterally. The multitiered cassette unit includes a plurality of sheet cassettes. The connector is configured to electrically connect the housing and the multitiered cassette unit. The multitiered cassette is attachable to a lower side of the connector. The fastening member is arranged in the recess. The fastening member is configured to fasten the housing and the connector to each other. The fastening member includes a screw being fastened laterally and a metal plate including a first section and a second section. The first section is engageable with the connector and extends in a horizontal direction. The second section extends upward from the first section and has an opening for the screw to be inserted therein.

BRIEF DESCRIPTION OF THE ACCOMPANYING DRAWINGS

DETAILED DESCRIPTION

An embodiment of the present disclosure will be described with reference to the accompanying drawings in the following paragraphs. In the following paragraphs, positional relation within an image forming apparatus 1 and each part or item included in the image forming apparatus 1 will be mentioned on basis of the orientation of the image forming apparatus 1 as indicated by arrows in each drawing. For example, a right-hand side and a left-hand side in FIG. 2 to a viewer may be referred to as a rear side and a front side of the image forming apparatus 1, respectively. A nearer side and a farther side in a direction of depth in FIG. 2 to the viewer may be referred to as a rightward side and a leftward side of the image forming apparatus 1, respectively. A right-to-left or left-to-right direction may be called as a widthwise direction, a front-to-rear or rear-to-front direction may be called as a front-rear direction. An up-to-down or down-to-up direction in FIG. 2 may be called as a vertical direction. A horizontal direction may be orthogonal to the vertical direction and may include the front-rear direction and the widthwise direction. Furthermore, directions of the drawings in FIGS. 1 and 3-10 are similarly based on the orientation of the image forming apparatus 1 as defined above and correspond to those with respect to the image reading apparatus 1 shown in FIG. 2 even when the drawings are drawn by different angles.

[Overall External Configuration of Image Forming Apparatus]

Figure 1:
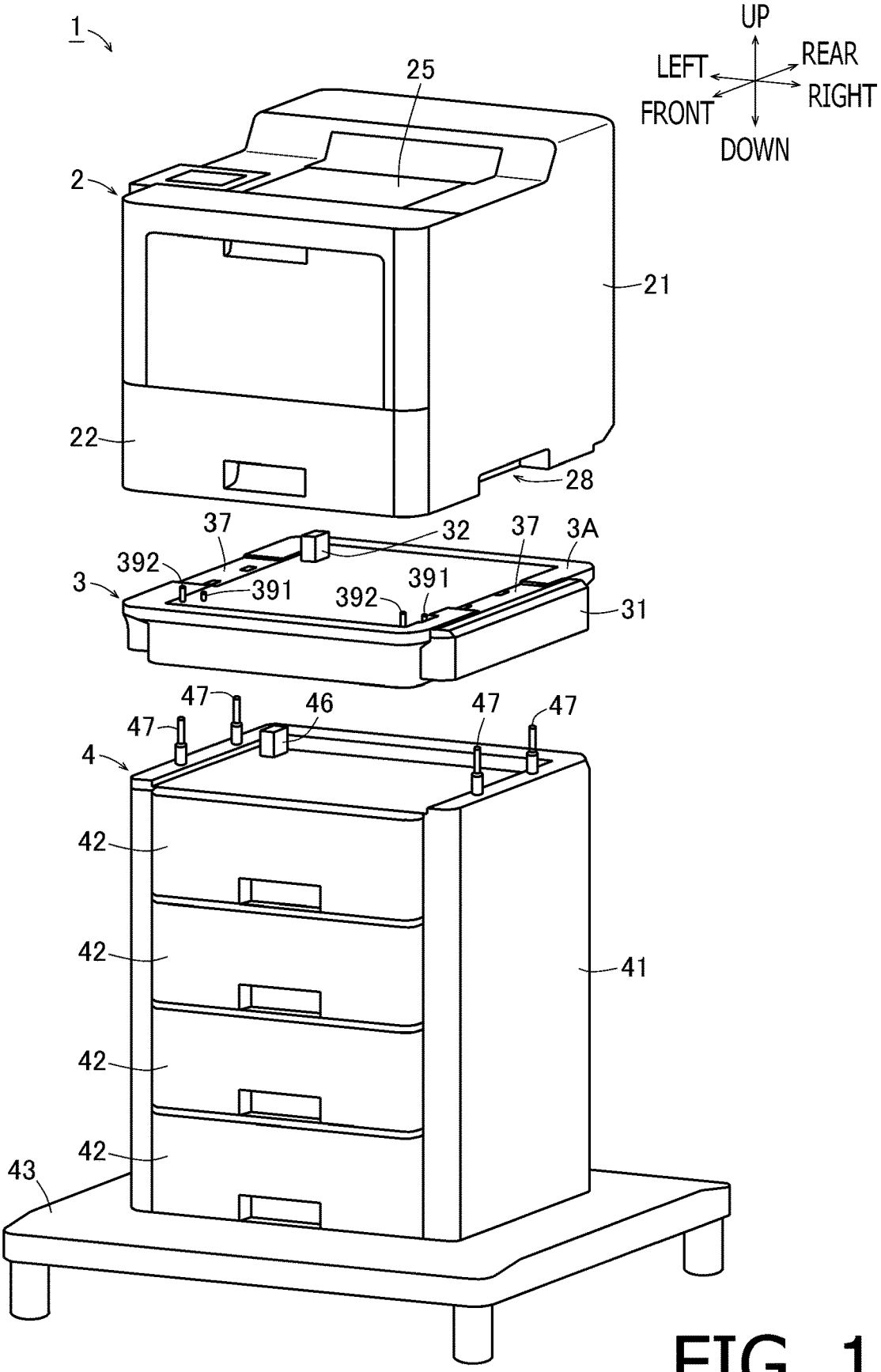
FIG. 1 is an exploded view of an image forming apparatus according to an embodiment of the present disclosure.

The image forming apparatus 1 includes, as shown in FIG. 1, a main body 2, a connector device 3, which may be optionally attached to the main body 2, and a multitiered cassette unit 4. The main body 2 may form images on sheets. The main body 2 includes a housing 21 and a sheet cassette 22. The housing 21 forms an exterior appearance of the main body 2 and may have an approximately rectangular shape. The sheet cassette 22 may be in a form of a box to support to one or more sheets therein. The sheet cassette 22 may be drawn outward or pushed inward from the front side to be stowed in the main body 2 removably.

The connector device 3 is optionally attachable to a lower side of the main body 2. The connector device 3 may electrically connect the main body 2 and the multitiered cassette unit 4, which is attachable to a lower side of the connector device 3. The connector device 3 has a housing 31, which forms an exterior appearance of the connector device 3 and may have an approximately rectangular shape.

The multitiered cassette unit 4 is attachable to the lower side of the connector device 3. The multitiered cassette unit 4 may store sheets to be fed to the main body 2. The multitiered cassette unit 4 may convey the sheets from a sheet cassette 42 to feed to the main body 2.

The multitiered cassette unit 4 includes a housing 41 and sheet cassettes 42. The housing 41 provides an exterior appearance of the multitiered cassette unit 4 and may have an approximately rectangular form. The sheet cassettes 42 may be drawn outward and pushed inward from the front side to be stowed in the housing 41 removably. The multitiered cassette unit 4 may stow two or more sheet cassettes 42. For example, the quantity of the sheet cassettes 42 may be, but not limited to, four (4).

The image forming apparatus 1 includes a supporting base 43, which may support the multitiered cassette unit 4 and thereby support the entire image forming apparatus 1 including the main body 2, the connector device 3.

It may be noted that the device optionally attachable to the lower side of the main body 2 may not necessarily be limited to the form of the connector device 3 described above. For example, the connector device 3 may be formed integrally with the multitiered cassette unit 4 as long as the connector device 3 is optionally attachable to the lower side of the main body 2.

[Internal Configuration of the Image Forming Apparatus]

Figure 2:
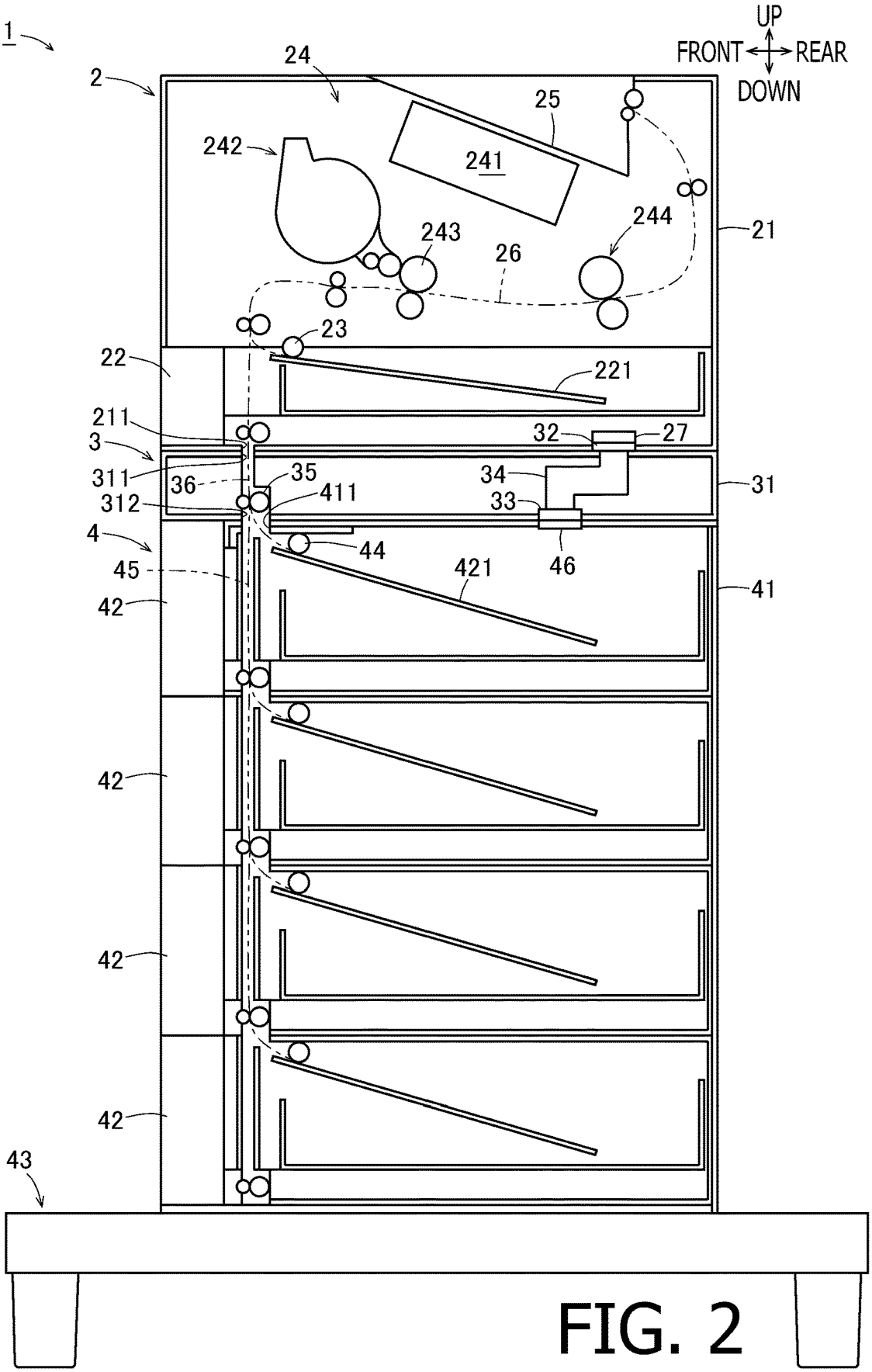
FIG. 2 is a cross-sectional view at a widthwise center of the image forming apparatus according to the embodiment of the present disclosure.

The main body 2 may be a laser printer having, as shown in FIG. 2, a sheet cassette 22, a feed roller 23, and an image forming device 24 accommodated in the housing 21 and an ejection tray 25 on an upper side of the housing 21. In the sheet cassette 22, a lifting plate 221, which may support sheets and swing vertically, is arranged. On a bottom face of the main body 2, at a position overlapping an opening 311 in the connector device 3 when the connector device 3 is at a correct position with respect to the main body 2, formed is an opening 211, through which a sheet may enter the main body 2. Between the opening 211 and the ejection tray 25 in the housing 21, a conveyer path 26, in which the sheet may be conveyed, is formed. Along the conveyer path 26, a plurality of conveyer roller pairs to convey the sheets are arranged.

The image forming device 24 is located on the conveyer path 26. The image forming device 24 includes a scanner unit 241, a process unit 242, and a fuser unit 244. The scanner unit 241 may emit laser beams at a photosensitive drum 243 according to image data. The process unit 242 contains the photosensitive drum 243 and forms an image in toner on the sheet being conveyed there-through. The fuser unit 24 may fuse the toner transferred onto the sheet to thermally fix the image on the sheet. The image forming device 24 may not necessarily be limited to a laser printer but may include, for example, an inkjet printer, a thermal-head printer, and other types of image forming apparatuses.

The sheets stored in the sheet cassette 22 may be uplifted by the lifting plate 221 to a predetermined position and fed by the feed roller 23 to the conveyer path 26. On the other hand, the sheet conveyed from the multitiered cassette unit 4 may enter the main body 2 through the opening 211 and may be conveyed to the conveyer path 26. The sheet may be conveyed along the conveyer path 26, an image may be formed by the image forming device 24 on the sheet being conveyed, and the sheet may be conveyed to the ejection tray 25 to be ejected outside the housing 21.

On a bottom face of the main body 2, arranged is a connector 27, through which power and controlling signals may be transmitted to the connector device 3. The connector 27 is connectable with a connector 32 on the connector device 3. On the bottom face of the main body 2, moreover, the main body 2 has a positioning section, which is not shown, to place the main body 2 at a correct position with respect to the connector device 3. The positioning section may include, for example, two (2) recessed portions and a plane portion.

The connector device 3 includes the connector 32, a connector 33, a cable 34, and a conveyer roller pair 35. The connector 32 is arranged on an upper face 3A of the connector device 3, and the connector 33 is arranged on a bottom face of the connector device 3. The cable 34 connects the connector 32 and the connector 33. With the connector device 3 attached to an upper side of the multitiered cassette unit 4, the connector 33 is connected with a connector 46, which is arranged on an upper face of the multitiered cassette unit 4. Moreover, with the main body 2 attached on top of the connector device 3, the connector 32 is connected with the connector 27 arranged on the bottom face of the main body 2.

Through the connector device 3, power may be delivered from the main body 2 to the multitiered cassette unit 4, and the controlling signals may be exchanged between the main body 2 and the multitiered cassette unit 4. Moreover, through a driving train, which is not shown but is arranged on the connector device 3, a driving force may be transmitted from the main body 2 to the multitiered cassette unit 4.

On the upper face 3A of the connector device 3, at the position overlapping the opening 211 in the main body 2 when the main body 2 is at the correct position with respect the connector device 3, formed is the opening 311, through which the sheet may enter the main body 2. On a bottom face of the connector device 3, at a position overlapping an opening 411 in the multitiered cassette unit 4 when the multitiered cassette unit 4 is at a correct position with respect to the connector device 3, formed is an opening 312, through which the sheet may enter the connector device 3. Between the opening 311 and the opening 312, a conveyer path 36, in which the sheet may be conveyed, is formed. Along the conveyer path 36, a conveyer roller pair 35 to convey the sheet is arranged. Thus, the sheet conveyed from the multitiered cassette unit 4 through the opening 312 may be conveyed along the conveyer path 36 and further conveyed through the opening 311 to the conveyer path 26 in the main body 2.

On the upper face 3A of the connector device 3, arranged are a positioning section 391 (see FIG. 1), which may place the main body 2 at a correct position with respect to the connector device 3 in the vertical direction, and a positioning section 392 (see FIG. 1), which may place the main body 2 at a correct position with respect to the connector device 3 in the front-rear and widthwise directions. Each of the positioning section 391, 392 may include, for example, two (2) protrusions.

With the main body 2 attached to the upper side of the connector device 3, the positioning section 391, 392 on the connector device 3 may engage with the positioning section on the main body 2; thereby, the main body 2 may be placed at the correct position in the vertical, front-rear, and widthwise directions. For example, the positioning section 391 on the connector device 3 may contact a plane area on the main body 2, and the main body 2 may be placed at the correct position in the vertical position. At the same time, the positioning section 392 on the connector device 3 may engage with the recessed portion on the main body 2, and the main body 2 may be placed at the correct position in the front-rear and widthwise directions. Moreover, on the bottom face of the connector device 3, arranged is a lower-side positioning section, which is not shown, to place the multitiered cassette unit 4 at a correct position with respect to the connector device 3. For example, four (4) recessed portions may form the lower-side positioning section.

The multitiered cassette unit 4 includes, for example, four (4) sheet cassettes 42 and four (4) feed rollers 44 corresponding to the sheet cassettes 42 on one-to-one basis. Each sheet cassette 42 includes a lifting plate, which may support sheets thereon and swing vertically. On the upper face of the multitiered cassette unit 4, at the position overlapping the opening 312 in the connector device 3, formed is the opening 411, through which the sheet may enter the connector device 3. Between the opening 411 and a lowermost one of the sheet cassettes 42, a conveyer path 45, in which the sheet may be conveyed, is formed. Along the conveyer path 45, a plurality of conveyer roller pairs to convey the sheet are arranged.

The sheets stored in the sheet cassette 42 may be uplifted by the lifting plate 421 to a predetermined position and fed by the feed roller 44 to the conveyer path 45. The sheet may be conveyed along the conveyer path 45 and conveyed to the connector device 3 through the opening 411.

On the upper face of the multitiered cassette unit 4, arranged is a connector 46, through which power and controlling signals may be delivered to the multitiered cassette unit 4. The connector 46 is connectable with the connector 33 on the connector device 3. On the upper face of the multitiered cassette unit 4, moreover, the multitiered cassette unit 4 has a positioning section 47 (see FIG. 1) to place the multitiered cassette unit 4 at the correct position with respect to the connector device 3. The positioning section may be formed of, for example, four (4) protrusions. With the connector device 3 attached to the upper side of the multitiered cassette unit 4, the lower-side positioning sections on the connector device 3 may engage with the positioning section 47 on the multitiered sheet cassette 4; thereby, the connector device 3 may be placed at the correct position in the vertical, front-rear, and widthwise directions.

[Fastening the Main Body to the Connector Device]

As shown in FIGS. 3-6, at a lower position on each of lateral sides, i.e., a rightward side and a leftward side, of the housing 21 of the main body 2, a recessed section 28, at which a user may clutch by his/her hand, is formed. The recessed section 28 includes a lateral-face section 281, an upper-face section 282, a front-face section 283, and a rear-face section 284: The lateral-face section 281 spreads in the vertical direction and the front-rear direction, the upper-face section 282 extends outward in the widthwise direction from an upper end of the lateral-face section 281, the front-face section 283 spreads downward in the vertical direction and inward in the widthwise direction from a front end of the lateral-face section 281, and the rear-face section 284 spreads downward in the vertical direction and inward in the widthwise direction from a rear end of the lateral-end section 281. Thus, the recessed section 28 is open laterally and downward. On the lateral-face section 281, at positions overlapping openings 533 in a metal plate 53, which will be described further below, formed are openings 285, in which screws 54 may be inserted.

At a position on the upper face 3A of the connector device 3 to face the recessed section 28, formed is a dented section 37. The dented section 37 may add space to the laterally open space formed in the recessed section 28; therefore, the user may be provided with larger work space to attach the metal plate 53, the screws 54, and a cover 55 to the main body 2 and the connector device 3 easily.

To each of the recessed sections 28, a fastening member 5 to fasten the main body 2 and the connector device 3 to each other is provided. The fastening members 5, which are located in the recessed sections 28, may not be easily recognizable to the user. Moreover, the recessed sections 28 to clutch by the user's hands may also be used as the space, in which the fastening members 5 are located. Therefore, no dedicated space to place the fastening member 5 at another location, which may be not be easily recognizable, is needed. Further, with the fastening members 5 located at two (2) positions, on one side and the other side in the widthwise direction, the main body 2 and the connector device 3 may be fixed to each other stably. The fastening members 5 on the right and the left are symmetrical; therefore, in the following paragraphs, the fastening member 5 located in the recessed section 28 on the right alone will be described representatively.

Figure 3:
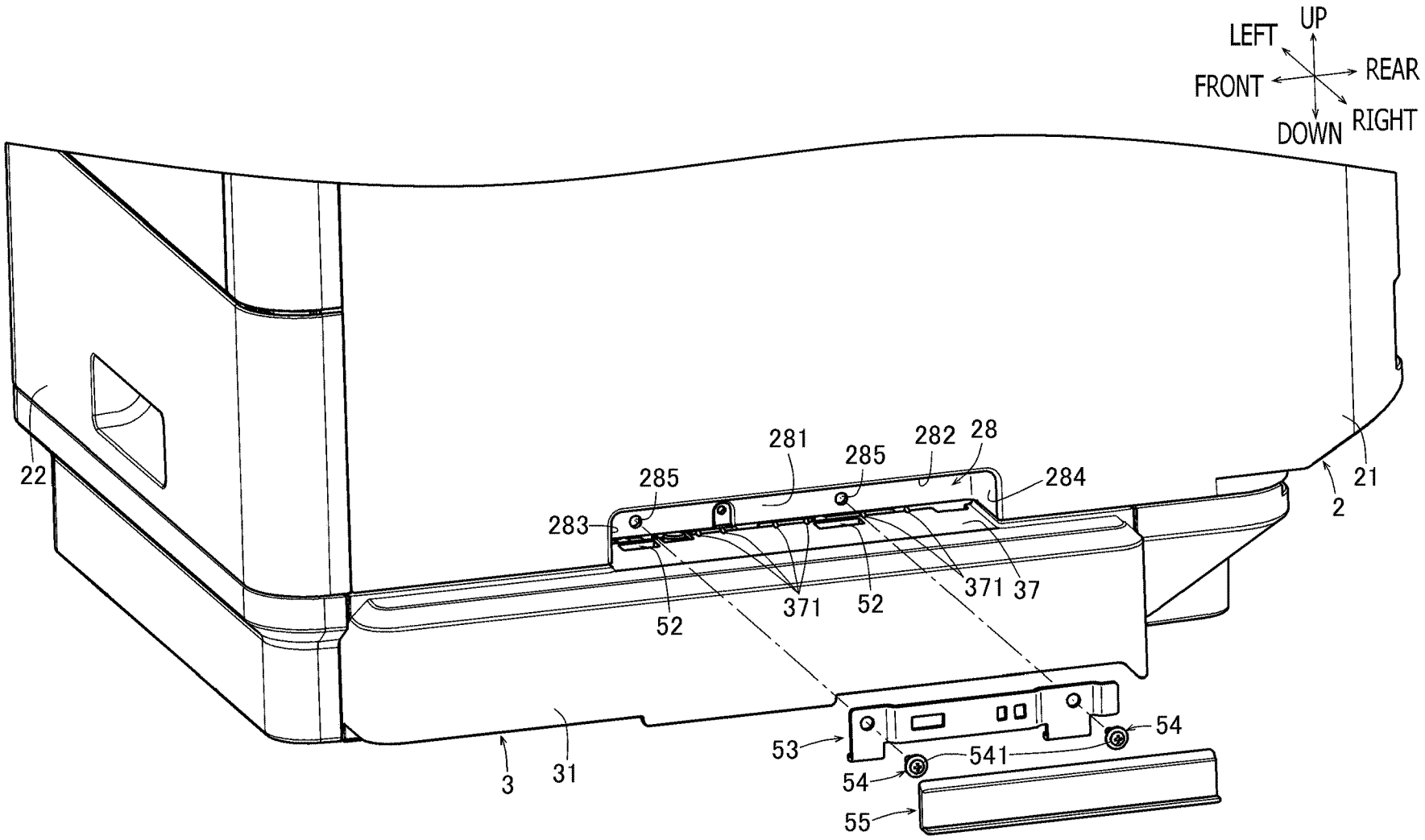
FIG. 3 is an exploded partial view of a main body and a connector device according to the embodiment of the present disclosure.

As shown in FIG. 3, the fastening member 3 includes the metal plate 53, two (2) screws 54, and the cover 55. Optionally, the fastening member 5 may consist of different pieces, which may function in the same manner as the metal plate 53, the screws 54, and the cover 55.

Figure 5:
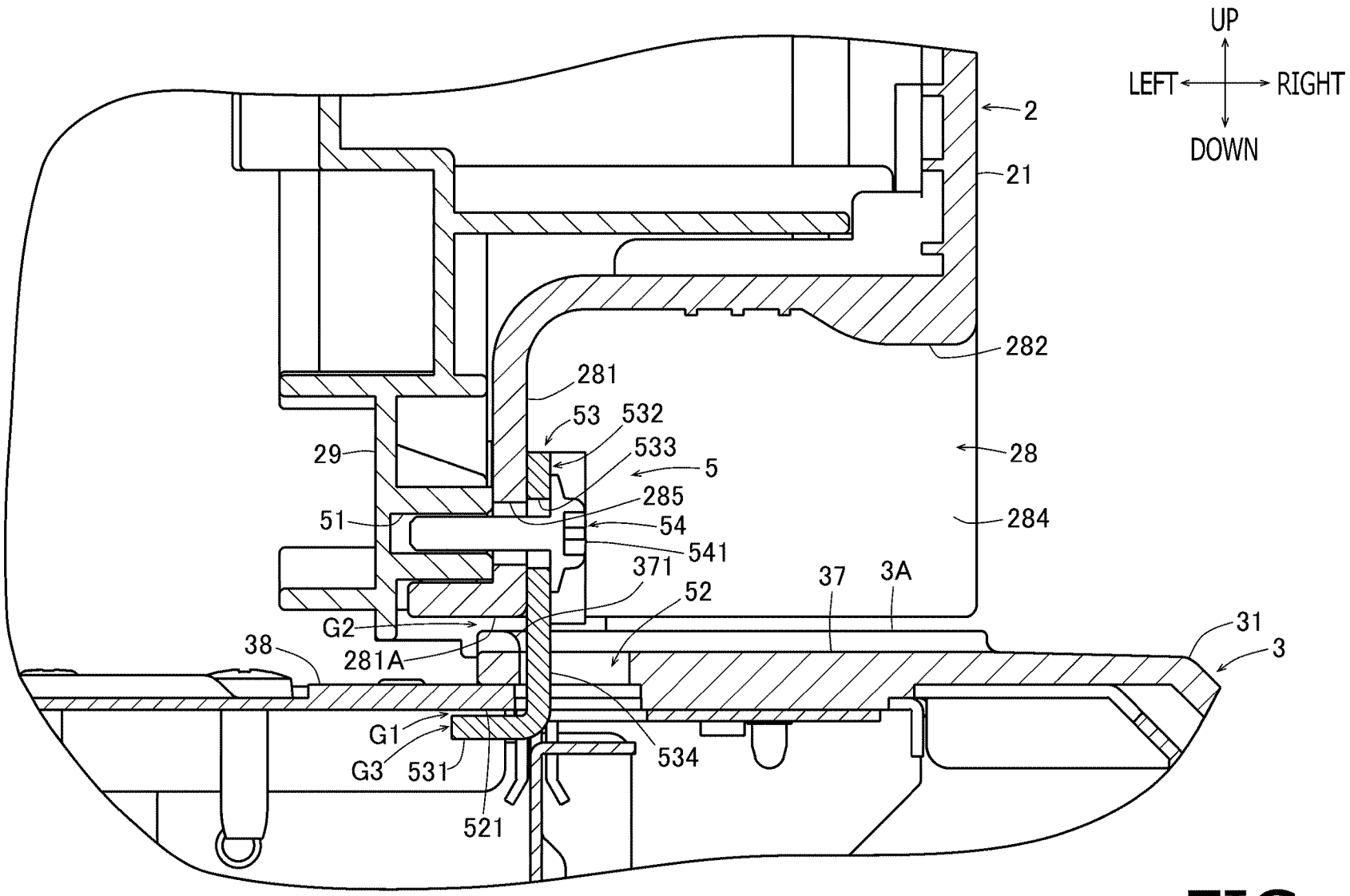
FIG. 5 is a cross-sectional view at a section A-A shown in FIG. 4 in the image forming apparatus according to the embodiment of the present disclosure.

As shown in FIG. 5, the main body 2 has a frame 29, which may be formed of, for example, resin, inside the housing 21. In the frame 29, two (2) screw holes 51 are formed. The screw holes 51 are formed at positions to overlap the openings 285 in the recessed section 28 in the housing 21. The screw holes 51 may fixedly hold the screws 54, which are inserted in the openings 533 through the metal plate 53 and in the openings 285 formed in the recessed section 28, by threads.

The connector device 3 includes a frame 38, which may be formed of, for example, a metal plate, inside the housing 31. In the connector device 3, two (2) rectangular holes 52 are formed vertically through the dented section 37 on the upper face 3A and the frame 38. Each hole 52 is formed at a position and in a size to allow a first section 531 of the metal plate 53, which will be described further below, to be inserted therein to enter the connector device 3. A peripheral section 521 around the hole 52 in the frame 38 may engage with the first section 531.

Figure 9:
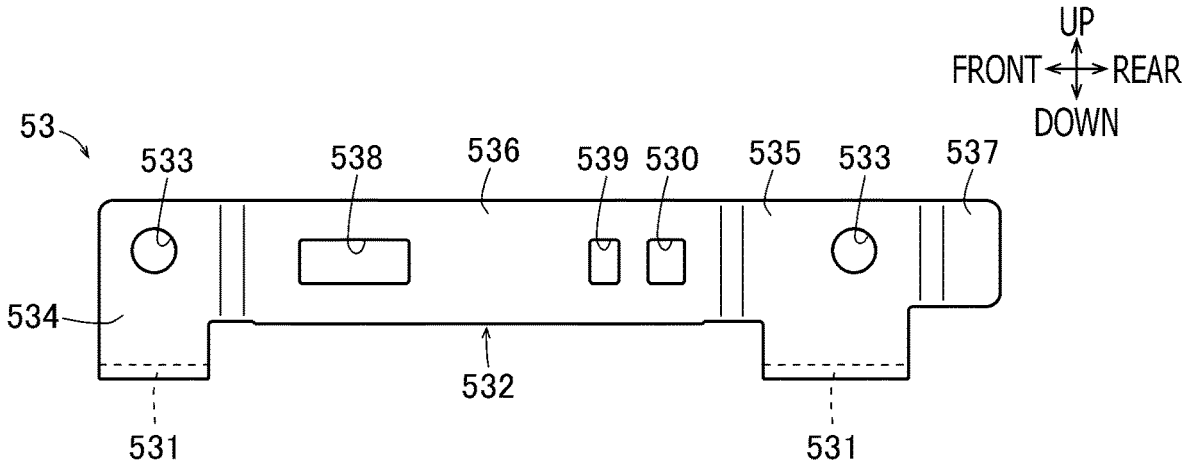
FIG. 9 is a sideward view of a metal plate in the image forming apparatus according to the embodiment of the present disclosure.
Figure 10:
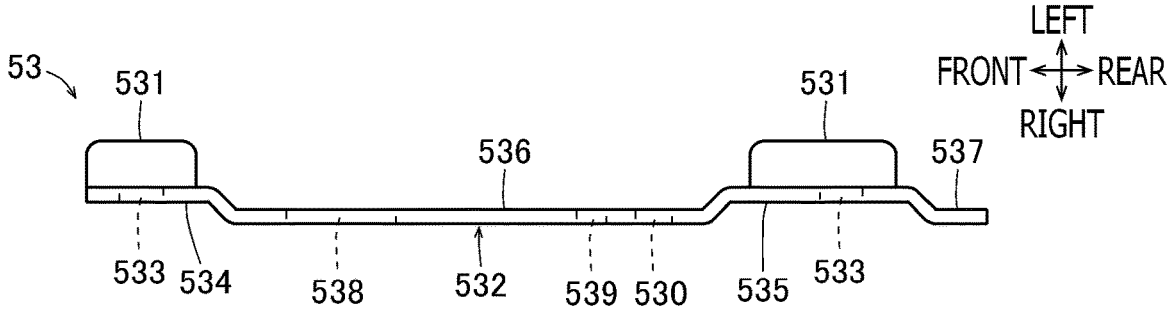
FIG. 10 is a plan view of the metal plate in the image forming apparatus according to the embodiment of the present disclosure.

The metal plate 53 may engage with the frame 38 of the connector device 3 to be fixed to the frame 29 of the main body 2. The metal plate 53 made of metal may fasten the frames 38, 29 to each other substantially rigidly. As shown in FIGS. 5, 9, and 10, the metal plate 53 includes the first section 531, which extends in the horizontal direction, to be engaged with the connector device 3, and a second section 532, which extends upward from the first section 531, when the metal plate 53 is attached to the main body 2, as will be described further below. In the second section 532, formed are the openings 533, in which the screws 54 may be inserted.

The first section 531 is arranged at two (2) locations, one of which is at a frontward position, and the other of which is at a rearward position. Each first section 531 has a substantial length in the widthwise direction to engage with the frame 38 of the connector device 3. The first section 531 and the frame 38 are spaced apart from each other by a gap G1, as shown in FIG. 5. Therefore, when an upward external force is applied to the main body 2, the first section 531 may contact the frame 38, and the main body 2 may be prevented from being detached from the connector device 3. Moreover, when the user works to attach the metal plate 53 to the main body 2, the user may be benefitted by the gap G1 providing a margin to attach the metal plate 53 easily. Optionally, however, the first section 531 and the frame 38 may not necessarily be separated from each other but may be arranged to contact each other.

The first section 531 is located at least at a position corresponding to the opening 533 in the second section 532. The position corresponding to the opening 533 may mean, for example, a position overlapping vertically in a lateral view along the widthwise direction as shown in FIG. 9. According to this arrangement, the screw 54 may fasten the connector device 3 to the main body 2 at the position corresponding to the first section 531; therefore, the main body 2 and the connector device 3 may be fastened to each other more rigidly.

The second section 532 includes inner plate sections 534, 535, an outer plate section 536, and an outer plate section 537. The inner plate sections 534, 535 extend upward from the first sections 531. The outer plate section 536 connects the inner plate section 534 and the inner plate section 535. The outer plate section 537 extends rearward from a rear end of the inner plate section 535. In each of the inner plate sections 534, 535, the opening 533 is formed.

The outer plate section 536 curves from the inner plate sections 534, 535 to extend on an outer side, i.e., on a rightward side in the orientation shown in FIG. 10, with respect to the inner plate sections 534, 535. In the outer plate section 536, as shown in FIG. 9, a first opening 538, a second opening 539, and a third opening 530, which are in rectangular shapes, are formed to align in the front-rear direction. The outer plate section 537 curves from the inner plate section 535 to extend on the outer side, i.e., on the rightward side in the orientation shown in FIG. 10, with respect to the inner plate section 535.

Figure 7:
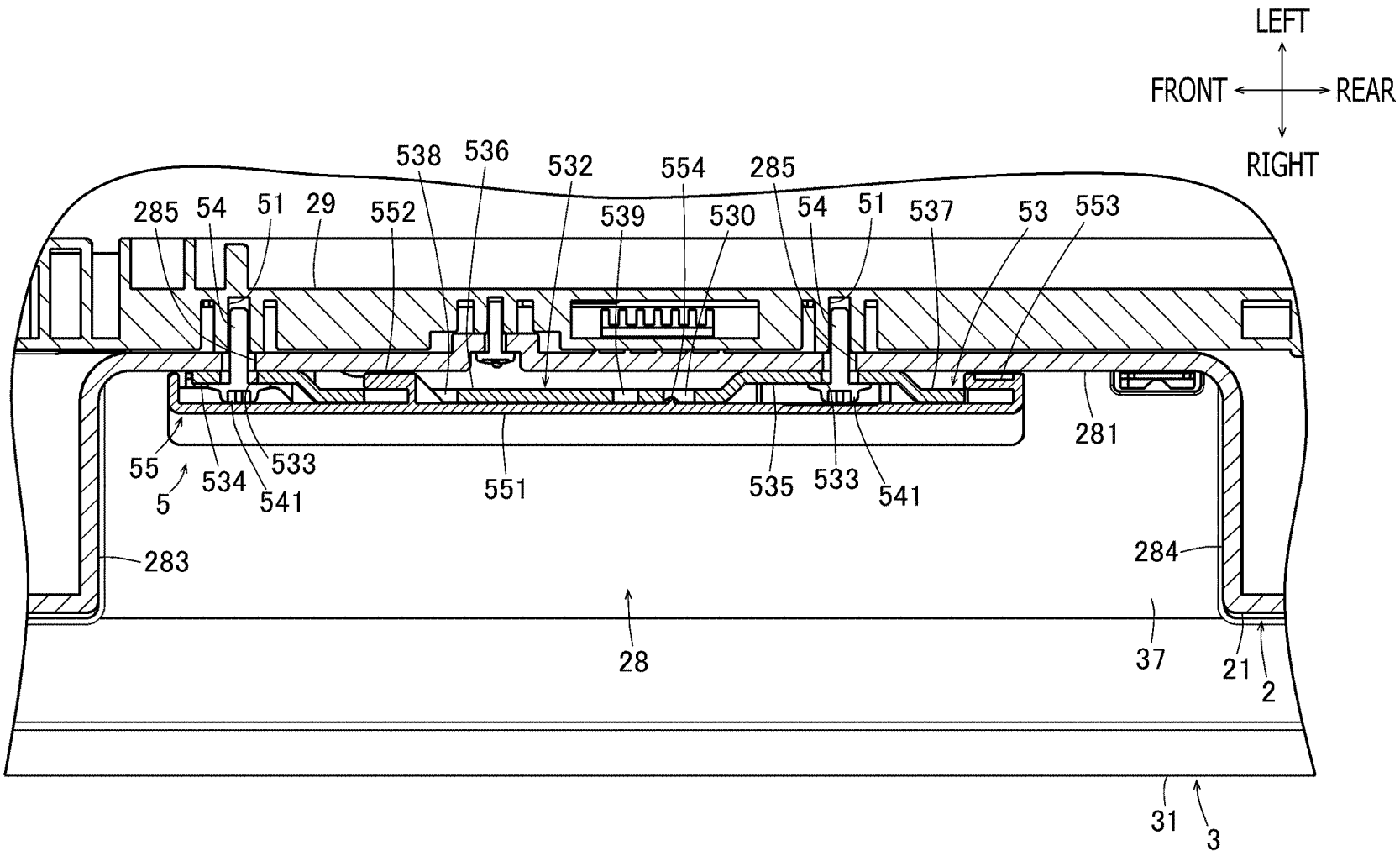
FIG. 7 is a cross-sectional view of the recessed section, with the cover being at an interim position to be attached thereto, and the periphery thereof in the image forming apparatus according to the embodiment of the present disclosure.
Figure 8:
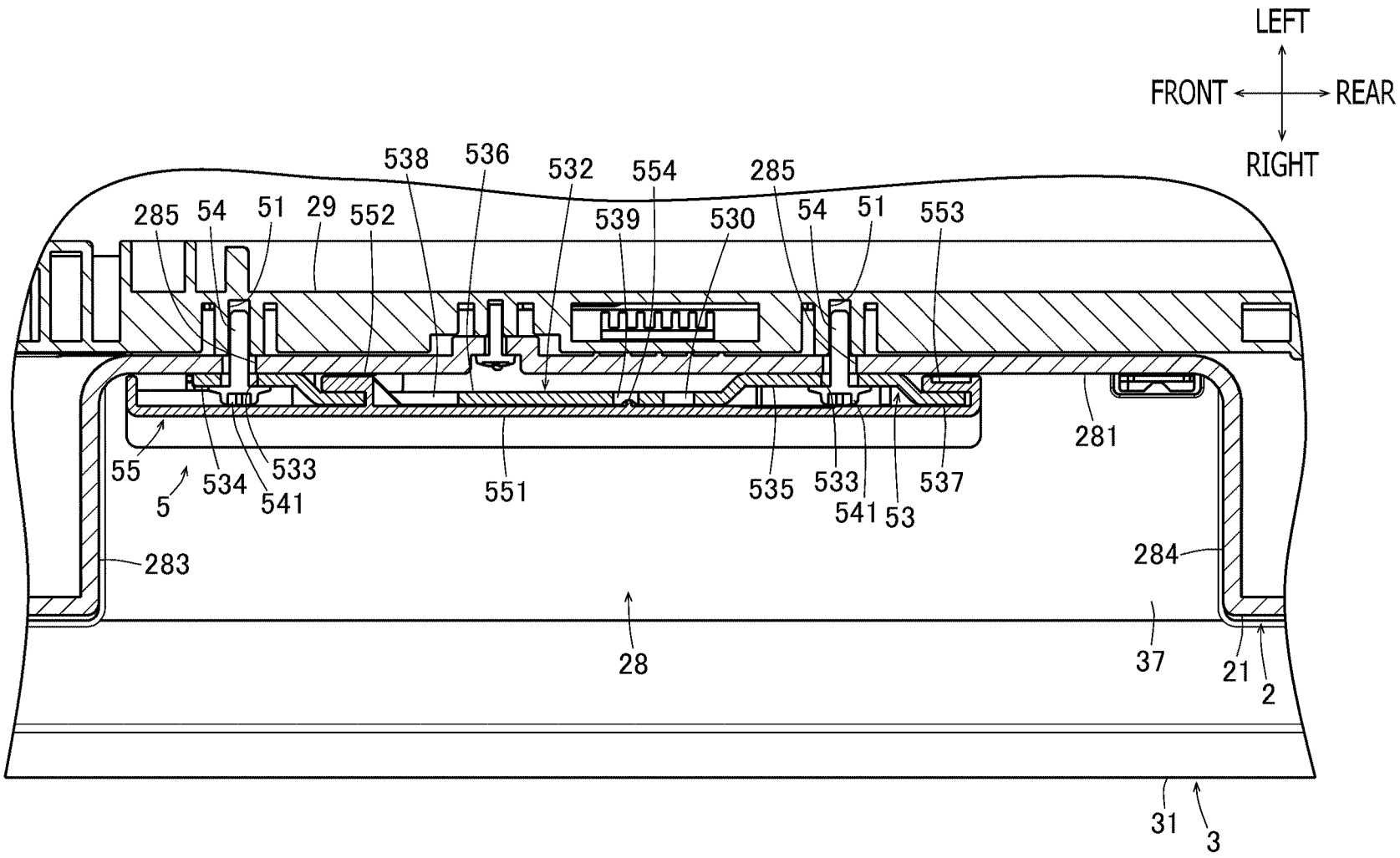
FIG. 8 is a cross-sectional view of the recessed section, with the cover fully attached thereto, and the periphery thereof in the image forming apparatus according to the embodiment of the present disclosure.

A protrusive amount of the outer plate sections 536, 537 with respect to the inner plate sections 534, 535 is greater than a thickness of a head 541 of the screw 54. Therefore, as shown in FIGS. 7 and 8, the heads 541 of the screws 54 may not interfere with a sliding movement of the cover 55, which will be described further below.

Figure 4:
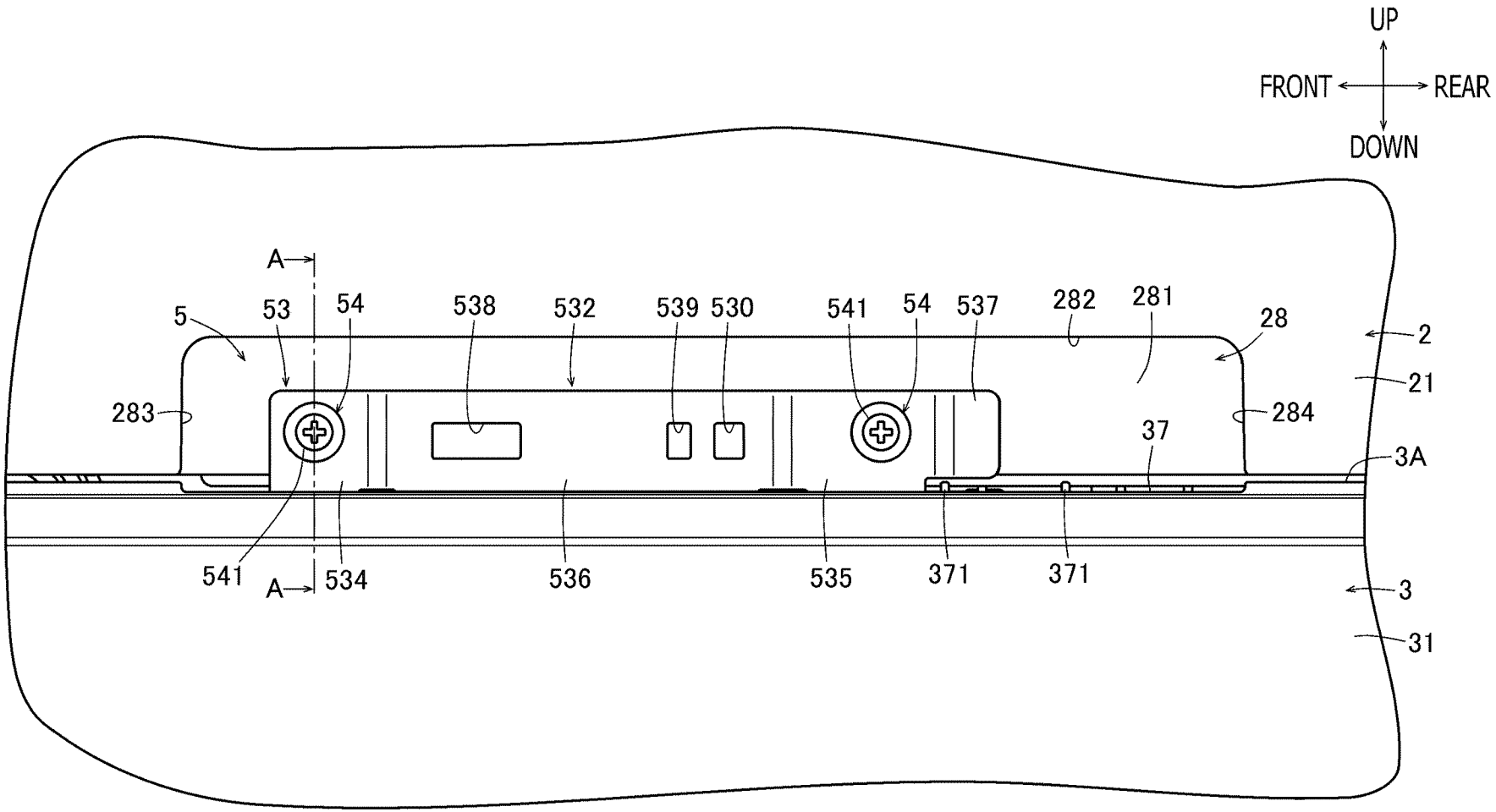
FIG. 4 is a rightward side view of a recessed section, without a cover, and a periphery thereof in the image forming apparatus according to the embodiment of the present disclosure.

In the arrangement as shown in FIG. 3, in which the main body 2 is placed on top of the connector device 3, in order to attach the metal plate 53 to the main body 2 and the connector device 3, the first section 531 may be inserted in the hole 52, and, as shown in FIGS. 4 and 5, the screws 54 may be attached to the metal plate 53 by being tightened while the inner plate sections 534, 535 of the second section 532 are pressed against the lateral-face section 281 in the recessed section 28.

Meanwhile, a lower end 281A of the lateral-face section 281 in the recessed section 28 in a view from the right-hand side is located laterally inward with respect to the hole 52 as shown in FIG. 5 and is spaced vertically apart from the connector device 3 by a gap G2, of which amount in the vertical direction is smaller than a thickness of the first section 531. In order to form the gap G2 between the lower end 281A of the lateral-face section 281 and the connector device 3, a plurality of ribs 371, of which height is substantially equal to a dented depth of the dented section 37 in the connector device 3, are formed in the dented section 37 at positions to face the lower end 281A of the lateral-face section 281. Therefore, when the user is attaching the metal plate 53 to the main body 2 and the connector device 3, the first section 531 may be prevented from being erroneously inserted in gap G2. Moreover, with the gap G2, the recessed section 28 may be prevented from contacting the connector device 3; therefore, the recessed section 28 may be restrained from affecting the positioning section 391 to locate the main body 2 at the correct vertical position with respect to the connector device 3.

As shown in FIG. 3, the screws 54 may fix the metal plate 53 to the main body 2. While the recessed section 28 is open laterally, i.e., leftward or rightward, the screws 54 to be inserted in the screw holes 51 may be moved by the user rightward or leftward along the widthwise direction easily through the recessed section 28. Therefore, the user's working efficiency may be improved.

Figure 6:
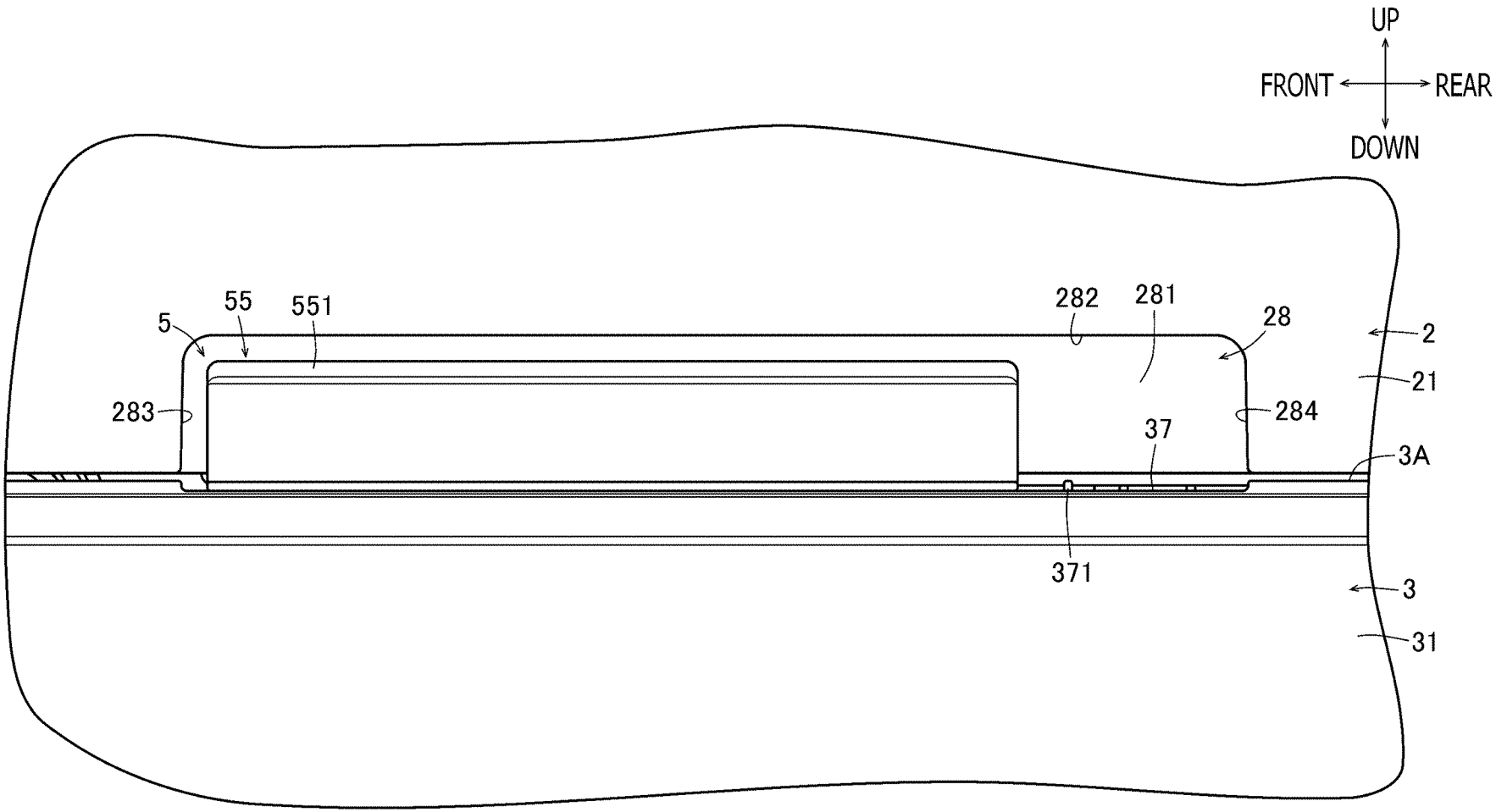
FIG. 6 is a rightward side view of the recessed section, with the cover fully attached thereto, and the periphery thereof in the image forming apparatus according to the embodiment of the present disclosure.

As shown in FIG. 6, the cover 55 may cover the second section 532 of the metal plate 53. The cover 55 is arranged not to protrude from the recessed section 28. With the cover 55 covering the metal plate 53 and the screws 54, the fastening member 5 may be restrained from being visually recognized more effectively.

As shown in FIGS. 7 and 8, the cover 55 includes a plate section 551, a first nipping section 552, a second nipping section 553, and a protrusive section 554. The first nipping section 552 may nip the outer plate section 536 in the metal plate 53, and the second nipping section 553 may nip the outer plate section 537 in the metal plate 53. The protrusive section 554 may fit in the second opening 539 or the third opening 530 in the metal plate 53. The plate section 551 may be a substantially rectangular plate member having a substantial breadth to cover the second section 532 of the metal plate 53, which may otherwise be exposed in the recessed section 28.

The first nipping section 552 protrudes inward from an inner face of the plate section 551 and bends frontward in a cross-sectional shape of an L to nip the outer plate section 536 of the metal plate 53 from the rearward side together with the plate section 551 through the first opening 538 formed in the metal plate 53. The second nipping section 553 protrudes inward from a rear end of the plate section 551 and bends frontward in a cross-sectional shape of an L to nip the outer plate section 537 of the metal plate 53 from the rear side together with the plate section 551. The protrusive section 554 is a protrusion formed on the inner face of the plate section 551 to fit in the second opening 539 or the third opening 530 when the cover 55 slides.

When the metal plate 53 is attached to the main body 2 and the connector device 3, as shown in FIG. 4, in order to attach the cover 55 to the metal plate 53, the cover 55 may be pressed against the metal plate 53, as shown in FIG. 7, and may be moved to slide frontward as shown in FIG. 8. In the cover 55 at the position shown in FIG. 7, the first nipping section 552 may be inserted in the first opening 538, and the protrusive section 554 may be fitted in the third opening 530.

The cover 55 may be moved to slide frontward from the position shown in FIG. 7 to the position shown in FIG. 8. In the cover 55 at the position shown in FIG. 8, the first nipping section 552 may nip the outer plate section 536, the second nipping section 553 may nip the outer plate section 537, and the protrusive section 554 may fit in the second opening 539. Thus, the cover 55 may be easily attached to the metal plate 53 by sliding.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

More Examples

For example, the recessed sections 28 to clutch by the user's hands may not necessarily be open both laterally and downward but may be open, for example, laterally alone or downward alone, as long as the recessed sections 28 may allow the user to clutch by his/her hands thereon.

For another example, the metal plate 53 may not necessarily have the first section 531 and the second section 532 as long as the metal plate 53 may fasten the main body 2 and the connector device 3 to each other. For example, a plane metal plate may be attached to the connector device 3 to protrude upward from the connector device 3.

For another example, the first section 531 may not necessarily be arranged at the position to overlap at least with the opening 533 in the second section 532 but may be, for example, arranged at a position corresponding to an entire range of the second section 532 or may be, for another example, arranged at a position different from the opening 533.

For another example, the cover 55 may not necessarily be attachable to the metal plate 53 by sliding. For example, the cover 55 may have a protrusion, which may be fitted in a hole formed in the metal plate.

For another example, the dented section 37 may not necessarily be formed on the upper face 3A of the connector device 3 but may be omitted.

What is claimed is:

1. An image forming apparatus, comprising:

a main body including an image forming device;

an optional device configured to be attached to a lower side of the main body;

a recessed section for clutching by a hand, the recessed section being formed at a lower position in the main body; and a fastening member arranged in the recessed section, the fastening member being configured to fasten the main body and the optional device to each other, wherein the recessed section is open laterally, wherein the fastening member includes a screw to be fastened laterally and a plate, wherein the main body has a lateral face section forming a part of the recessed section on a laterally inner side in the recessed section, the lateral face section extending in a vertical direction, and wherein the plate is attached to the lateral face section from a laterally outer side with the screw being inserted therethrough laterally.

2. The image forming apparatus according to claim 1, wherein the plate is a metal plate, the metal plate having:

a first section engageable with the optional device, the first section extending, when engaged with the optional device, in a horizontal direction; and a second section extending, when the first section is engaged with the optional device, upward from the first section, the second section having an opening for the screw to be inserted therein.

3. The image forming apparatus according to claim 2, wherein the first section is located at least at a position corresponding to the opening in the second section.

4. The image forming apparatus according to claim 2, wherein the optional device includes:

a positional section configured to locate the main body at a correct position in the vertical direction; and an upper face having a hole, the hole allowing the first section of the metal plate to be inserted vertically therein to enter the optional device, wherein a lower end of the recessed section being located laterally inward with respect to the hole is spaced vertically apart from the optional device by a gap, of which amount is smaller than a thickness of the first section.

5. The image forming apparatus according to claim 4, wherein the fastening member includes a cover configured to cover the second section of the metal plate.

6. The image forming apparatus according to claim 5, wherein the cover includes a nipping section configured to nip the second section by a sliding movement of the cover.

7. The image forming apparatus according to claim 6, wherein a part of the second section of the metal plate to be nipped by the nipping section is located on the laterally outer side with respect to a part of the second section, in which the hole is formed.

8. The image forming apparatus according to claim 1, wherein the recessed section is open downward, and wherein the optional device has a dented section at a position facing the recessed section.

9. The image forming apparatus according to claim 1, wherein the recessed section is formed on each lateral side of the main body, and wherein the fastening member is arranged on each recessed section on each lateral side.

10. The image forming apparatus according to claim 1, wherein the optional device is a connector device configured to electrically connect the main body and a multitiered cassette unit, the multitiered cassette unit being attachable to a lower side of the optional device and including a plurality of sheet cassettes.

11. An image forming apparatus, comprising;

a photosensitive drum;

a sheet cassette;

a housing accommodating the photosensitive drum and the sheet cassette, the housing including a recess for clutching by a hand, the recess being formed at a lower position of the housing and being open laterally;

a multitiered cassette unit including a plurality of sheet cassettes, a connector configured to electrically connect the housing and the multitiered cassette unit, the multitiered cassette being attachable to a lower side of the connector, and a fastening member arranged in the recess, the fastening member being configured to fasten the housing and the connector to each other, the fastening member comprising:

a screw being fastened laterally; and a metal plate including a first section and a second section, the first section being engageable with the connector and extending in a horizontal direction, the second section extending upward from the first section and having an opening for the screw to be inserted therein.

12. An image forming apparatus, comprising:

a main body including an image forming device;

an optional device configured to be attached to a lower side of the main body;

a recessed section for clutching by a hand, the recessed section being formed at a lower position in the main body; and a fastening member arranged in the recessed section, the fastening member being configured to fasten the main body and the optional device to each other, wherein the optional device is a connector device configured to electrically connect the main body and a multitiered cassette unit, the multitiered cassette unit being attachable to a lower side of the optional device and including a plurality of sheet cassettes.

* * * * *